United States Patent [19]

Downey

[11] 4,284,982

[45] Aug. 18, 1981

[54] BATTERY OPERATED PERSONAL ALARM

[76] Inventor: John Downey, Attache Court North, Apt. 912, Shaughnessy Blvd., Don Mills, Ontario, Canada, M2J 1K2

[21] Appl. No.: 29,208

[22] Filed: Apr. 12, 1979

[51] Int. Cl.[3] ..... G08B 13/08; G08B 15/00

[52] U.S. Cl. ..... 340/546; 340/548; 340/574; 340/693

[58] Field of Search ..... 340/546, 574, 693, 562, 340/541, 548

[56] References Cited

U.S. PATENT DOCUMENTS

| | | | |
|---|---|---|---|
| 3,261,010 | 7/1966 | Kardel | 340/546 |
| 4,151,520 | 4/1979 | Full | 340/574 |

*Primary Examiner*—Glen R. Swann, III

[57] ABSTRACT

A battery operated personal alarm having a withdrawable actuating pin extending from the case thereof is provided with a multi-purpose handle attached to the exterior of the case, permitting attachment of the alarm to the person or purse-handle of a user in a first position, and in a second position permitting attachment of the alarm to a door handle for use as a portable burglar alarm. Removal of the handle from its inverted keyhole shaped aperture on the back of the case permits the hanging of the alarm from a screw head or a nail head attached to a fixed support, the actuating pin being attached by a lanyard to a relatively moveable object, for displacement thereby.

3 Claims, 3 Drawing Figures

BATTERY OPERATED PERSONAL ALARM

BACKGROUND OF THE INVENTION

This invention is directed to a portable, battery operated alarm, and in particular to a personal alarm having a dual purpose handle thereon.

Battery operated personal alarms embodying an audible warning or horn are well known, and are provided in a number of various guises, for specific usages.

Owing to the particularized arrangements there is a tendency to provide unduly specialized models unsuited for more universal application.

SUMMARY OF THE INVENTION

In accordance with the present arrangement the case of a battery operated personal alarm is provided with a mult-purpose handle permitting use, when in a first position as an alarm attached to the person of a user, such as by attachment to the waist belt, or to the handle of a purse. In a second, open position of the handle, the handle extends outwardly from the case of the alarm, permitting attachment of the alarm to a door handle as a portable and detachable burglar alarm.

In combination with the alarm, per se, are provided one or more removeable hooks for attachment to a door frame, to receive the actuating lanyard of the alarm in attached relation therewith, whereby upon opening of the door and displacement of the alarm to extend the lanyard, the alarm actuating pin is withdrawn from the alarm casing and the alarm is thus activated.

BRIEF DESCRIPTION OF THE DRAWINGS

Certain embodiments of the invention are described, reference being made to the accompanying drawings, wherein.

DESCRIPTION OF THE PREFERRED EMBODIMENT

Figure 1:
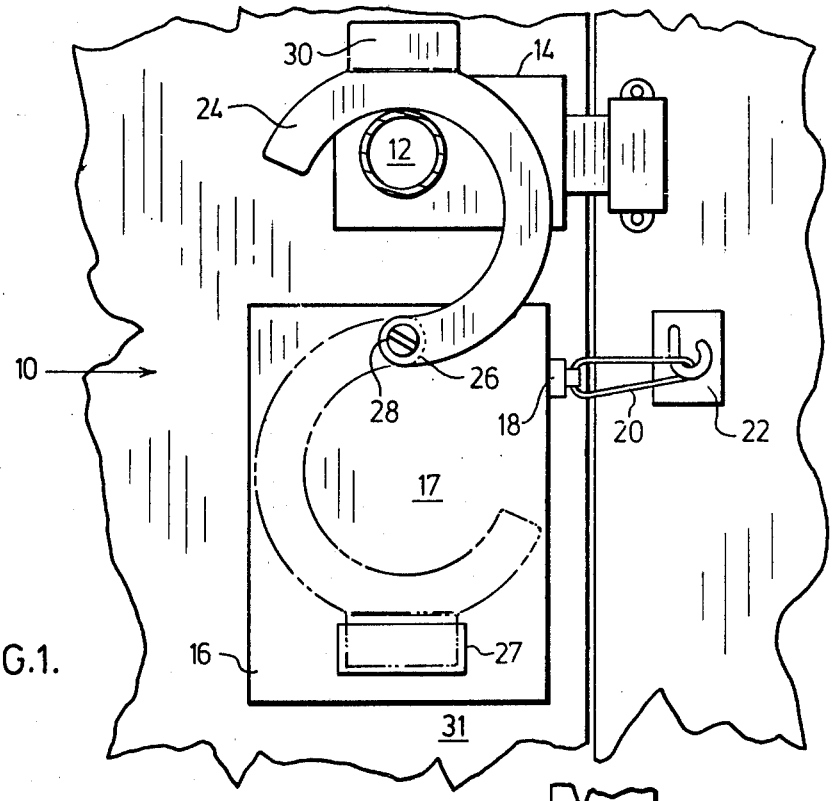
FIG. 1 is a rear view of the alarm showing the handle in the open position.

Referring to FIG. 1 the alarm 10 is illustrated in mounted relation on the knob 12 of a lock 14. The alarm 10 has a casing 16 containing a battery (not shown) and an alarm (also not shown).

A withdrawable pin 18 inserted in the side of case 16 causes actuation of the alarm, when withdrawn. A Lanyard loop 20 permits connection of the pin 18 to a desired object such as a hook 22.

The handle 24 has a boss portion 26 having an attachment pin 28 extending therethrough and entered in engaging relation with the back cover 17 of the case 16. The handle 24 also has a projecting lug portion 30 thereon which engages within a raised housing portion 27 of the back cover 17, when the handle 24 is positioned in the retracted position, shown chain dotted in FIGS. 1 and 2.

In this retracted position the handle 24, in cooperation with the back cover 17 of the case forms a passage wherein a waist belt or purse strap may be inserted, to secure the alarm to the person or the purse of a user. Attachment of the lanyard loop 20 in a fashion so as to effect withdrawal of the pin 18 upon performance of an undesired act by a third party makes the alarm effective to provide desired portection.

Figure 2:
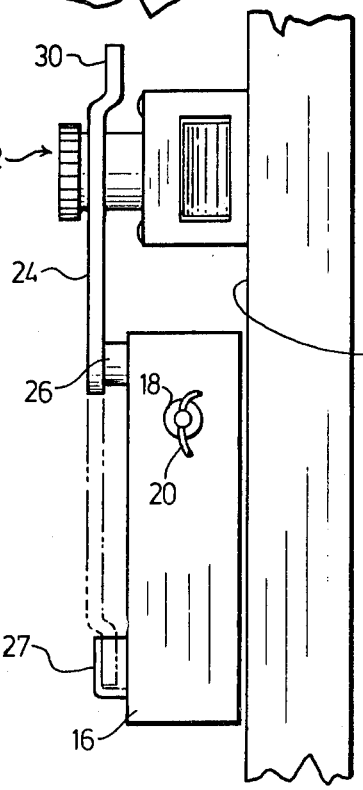
FIG. 2 is a side view, partially sectioned, showing the relative positions of the handle in the open and the closed position.

In the circumstance illustrated in FIGS. 1 and 2 wherein the alarm 10 is suspended from aknob 12 of a door lock 14, and with the lanyard 20 attached to a hook 22 mounted on the door jamb, displacement of the door towards an open position effects withdrawal of the pin 18 from the alarm thereby triggering the alarm.

The auxiliary hooks 22 may be provided with a contact adhesive, to permit ready attachment to any suitable surface.

The alarm is similarly usable with a window or any relatively moveable body.

In the illustrated embodiment, the attachment pin 28 of the handle has a radially extending detent permitting withdrawal of the pin 28 from the casing back 17 when in a predetermined position with an aperture shaped like an inverted keyhole (not shown) in the back 17.

Figure 3:
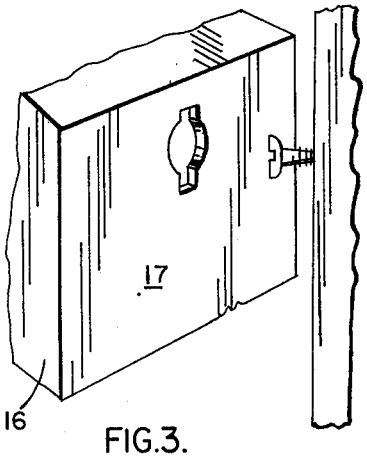
FIG. 3 is a partial general view showing the back of the alarm having the handle removed, in relation to a wall fastening.

The shaped aperture, having a narrow slot extending upwardly from a circular opening permits the alarm to be mounted upon the head of a screw or nail when the handle 24 is removed, by pushing the casing back 17 over the screw or nail head to engage the slot, as shown in FIG. 3.

What I claim by Letters Patent of the United States is:

1. A battery operated personal alarm having a readily portable casing, hook shaped handle means secured to the casing, having a first extended position for engagement in use with a desired object such as a door handle, and a second retracted position relative to said casing to provide in cooperation therewith a passage to receive a strap in inserted relation therein, a withdrawable alarm actuating pin entered in said casing and withdrawable therefrom in order to activate horn means within the casing, and lanyard means secured to the pin for attachment to a relatively moveable object to effect actuation of said alarm on relative displacement being effected between the object and the alarm to produce withdrawal of the pin.

2. The alarm as claimed in claim 1 wherein said handle means is withdrawable from said casing, to vacate an aperture in said casing for entry therein of a headed mounting device such as a screw.

3. A battery operated personal alarm having a readily portable casing, substantially planar hook-shaped handle means located in a plane substantially parallel with and closely adjacent a surface of said casing and selectively positionable in extended relation projecting outwardly from said casing for engagement in use with a desired object such as a door handle, and retractable into retracted closed relation with said casing for attachment to a strap therewith.

* * * * *